US005456095A

United States Patent [19]

Tawil et al.

[11] Patent Number: 5,456,095

[45] Date of Patent: Oct. 10, 1995

[54] INTERCHANGEABLE SETTING FOR JEWELRY PIECES

[76] Inventors: David Tawil, 941 Norwood Ave., Long Branch, N.J. 07740; Jack D. Tawil, 1987 Ocean Pkwy., Brooklyn, N.Y. 11223

[21] Appl. No.: 268,814

[22] Filed: Jun. 30, 1994

Related U.S. Application Data

[63] Continuation-in-part of Ser. No. 174,138, Dec. 28, 1993, abandoned, which is a continuation-in-part of Ser. No. 65,812, May 21, 1993, abandoned.

[51] Int. Cl.[6] ..... A44C 17/02

[52] U.S. Cl. ..... 63/29.1; 63/15; 24/593; 24/597; 403/349

[58] Field of Search ..... 63/29.1, 30, 15, 63/26; 24/593, 597, 703.1, 596; 403/349, 279, 22; 411/553, 551

[56] References Cited

U.S. PATENT DOCUMENTS

| | | | |
|---|---|---|---|
| 1,696,462 | 12/1928 | Victor | 403/349 |
| 2,108,324 | 2/1938 | White | 63/29.1 |
| 2,486,412 | 11/1949 | Huelster | 411/551 |
| 2,591,569 | 4/1952 | Lovell | 63/29.1 |
| 2,622,291 | 12/1952 | Drell | 24/597 |
| 3,800,369 | 4/1974 | Nikolits | 24/593 |
| 3,933,011 | 1/1976 | DiGilio | 63/29.1 |
| 4,982,581 | 1/1991 | Furuyama | 63/29.1 |
| 5,077,989 | 1/1992 | Dillabaugh | 63/29.1 |

*Primary Examiner*—Flemming Saether
*Attorney, Agent, or Firm*—Steven H. Bazerman

[57] ABSTRACT

An interchangeable setting for a jewelry piece for displaying an ornament comprises a holder for supporting the ornament and prongs on the holder for securing the ornament. The holder have a cylindrical extension having projections for insertion into a receiver. The receiver has walls defining a cavity for removably receiving the holder. At least one groove is provided on an inner wall defining the cavity of the receiver for detachable engagement with the projection of the post for detachably securing the holder to the receiver. The upper surface of the groove is angled to insure wobble-free engagement of the holder and the receiver.

11 Claims, 6 Drawing Sheets

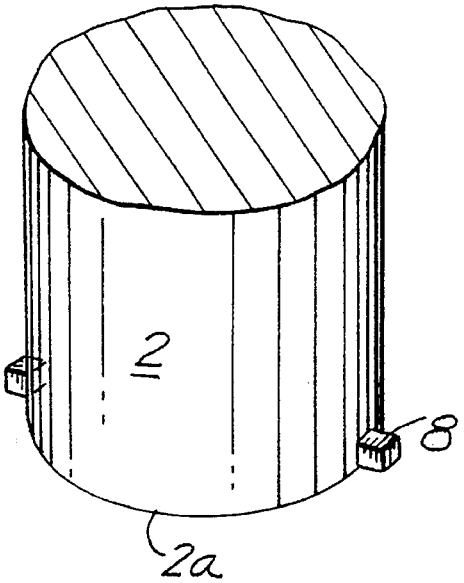
FIG. 3
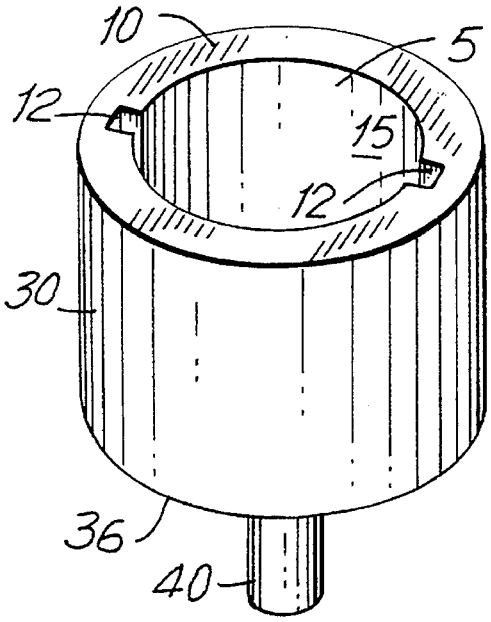
FIG. 4
FIG. 5
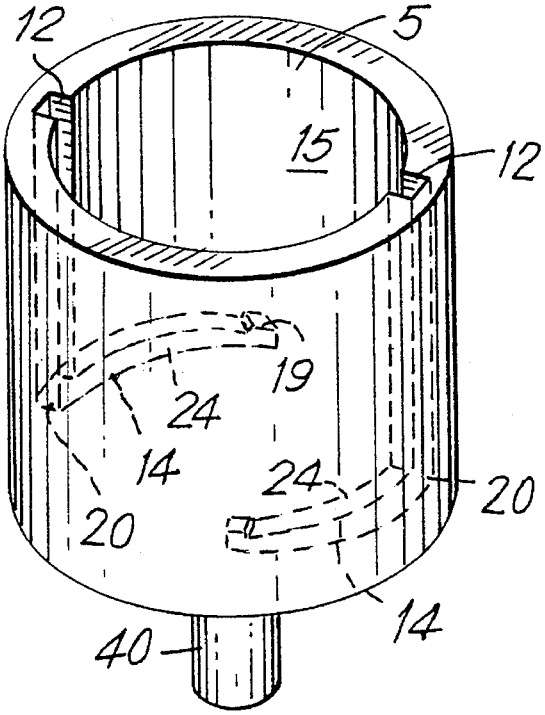
FIG. 6
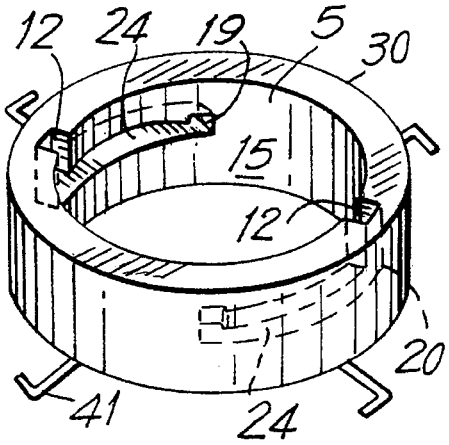

FIG.13
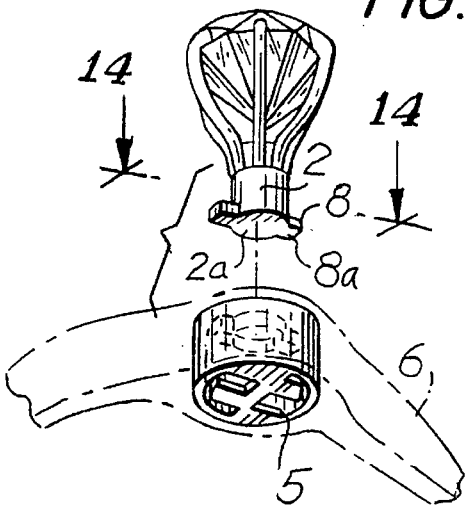
FIG.14
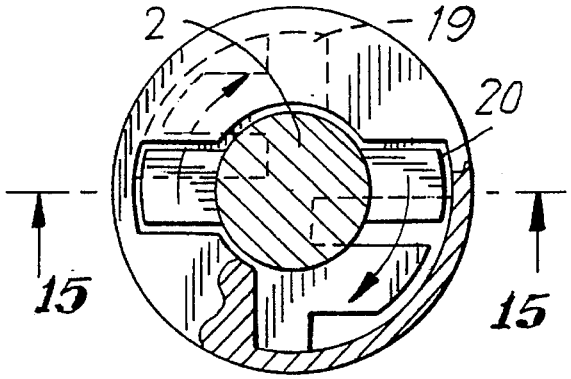
FIG.17
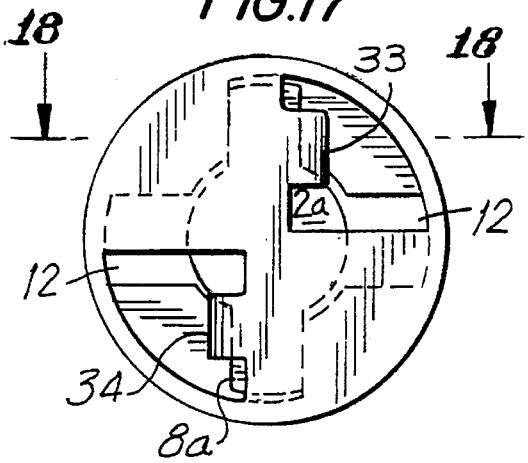
FIG.15
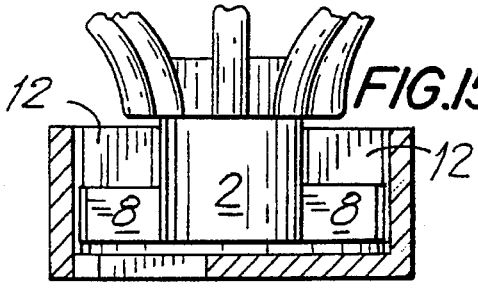
FIG.18
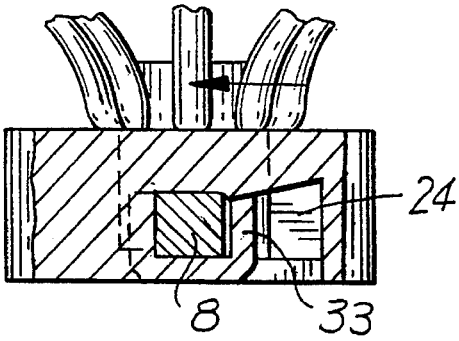
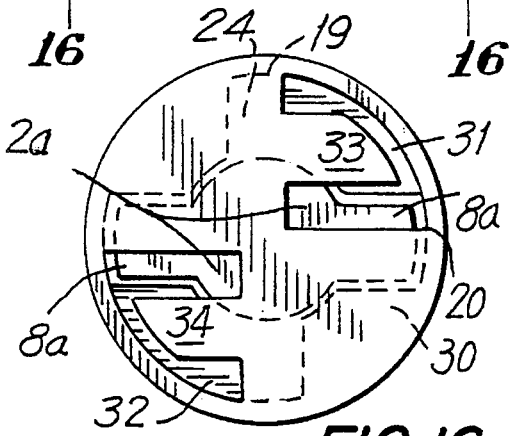
FIG.16

INTERCHANGEABLE SETTING FOR JEWELRY PIECES

The present application is a continuation-in-part of parent application Ser. No. 08/174,138 filed Dec. 28, 1993 now abandoned, which is in turn a continuation-in-part application of grandparent application Ser. No. 08/065,812 now abandoned, filed May 21, 1993.

FIELD AND BACKGROUND OF THE INVENTION

The present invention relates in general to jewelry and in particular to a new and useful interchangeable setting for jewelry pieces.

In the jewelry field, there are several known devices for temporarily attaching settings to jewelry pieces. U.S. Pat. No. 3,913,184 to Hanan discloses a jewelry setting lock-attaching structure lo which comprises a locking mechanism for securing a setting to a jewelry piece. The locking mechanism has a male shaft having a head at one end and supports a stone at the opposite end. The head of the male shaft is inserted into a female receptacle having spring-biased leg structures engageable with the shaft for securing the head of the shaft within the female receptacle. Force must be applied against the spring-biased leg structures in conjunction with a twisting action of the male shaft in order to withdraw the setting and unlock the device which can prove difficult. The female receptacle is provided in a ring which is tailor-made for the locking mechanism. This locking mechanism is confined to the special ring structure and is not applied to other types of jewelry pieces such as necklaces, bracelets, earrings, etc.

U.S. Pat. No. 4,905,482 to Gheblikian discloses a finger ring with interchangeable settings comprising a finger ring having a mounting with a face. The face has an opening which extends into a cavity in the mounting and a slot on one side of the cavity. The slot allows for access to the cavity and permits a setting such as a stone to be slid into the opening where it is exposed from the face of the ring. A slidable door is used to close off the slot on the side of the cavity when the setting is in place. This interchangeable setting is directed to the particular ring structure disclosed by this reference.

U.S. Pat. No. 3,933,011 to Digillo discloses a ring with an interchangeable setting secured by a slip and catch engagement means. No arrangement is provided to ensure a snug fit between the setting and the mounting and, as a result, the setting would have a tendency to allow movement between with two, thereby allowing the mounted gem to wobble. No structure is provided for the easy permanent attachment of the gem to the jewelry piece nor is any structure disclosed which will allow the use of such an interchangeable setting with unmodified commercial jewelry of all types.

Presently, there are no known devices for providing interchangeable settings for jewelry pieces that can be adapted to various types of jewelry such as rings, bracelets, earrings, etc., as generally available in the marketplace without alteration; and which provide for an efficient temporary securing of a setting to a jewelry piece which holds the setting rigidly in place but which has means to allow permanent securing of the setting when desired.

SUMMARY OF THE INVENTION

The present invention provides for an interchangeable mounting of an ornament, such as a gem, in a jewelry piece to allow the matching of various gems and pieces prior to a decision as to the final combination. Once the decision has been made the present invention allows for the easy permanent attachment of the gem in the jewelry piece. The setting comprises a mounting means for supporting the ornament and holding means on the mounting means to secure the ornament on a piece of jewelry. The holding means is so constructed as to provide close engagement between the setting and the jewelry so as to eliminate any movement between them when the setting is so mounted. The holding means may be in the form of an adapter which is permanently mounted on a conventional post on the mounting means. A receiver having walls defining a cavity is used to removably receive the holding means. An inner-wall of the receiver has at least one groove for detachable engagement with the insertion means of the holding means for detachably securing the holding means to the receiver. Clamping means are provided integral with the receiving means to aid permanently holding the ornament in place in the jewelry. In addition, one or more vents are provided in the receiving means to allow solder to be placed directly in contact with both the receiving means and the holding means when permanent attachment is desired. When the receiver is not integral with the jewelry piece, an adaptor or attachment means for attaching the receiver to the jewelry piece is provided.

The present invention allows for ornaments such as stones, gems, etc. to be interchanged with jewelry pieces such as rings, bracelets, earrings, etc. in an efficient and secure manner and when desired allow permanent attachment of the ornament by use of the clamping means and/or the application of solder or bonding agents through vents in the receiver.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 3 is a perspective view of the holding means portion of the setting in accordance with the present invention;

FIG. 4 is a perspective view of an adaptor incorporating a receiver in accordance with the present invention for use with a piece of jewelry;

FIG. 5 shows the adaptor of FIG. 4 with the channels in the wall of the adaptor shown by dotted lines;

FIG. 6 is a perspective view of an alternative form of adaptor in the form of a bridge for mounting the receiver in a piece of jewelry in accordance with the present invention;

FIG. 13 is an exploded perspective view of a setting and receiving element of another embodiment of the present invention;

FIG. 14 is a cross-section taken along lines 14—14 of FIG. 13;

FIG. 15 is a cross-section taken along lines 15—15 of FIG. 14;

FIG. 16 is a bottom plane view taken along lines 16—16 of FIG. 15;

FIG. 17 is a view similar to that of FIG. 16, but with clamping means bent to hold the holding means in position; and FIG. 18 is a cross-section taken along lines 18—18 of FIG. 17.

DESCRIPTION OF THE PREFERRED EMBODIMENTS

Figure 1:
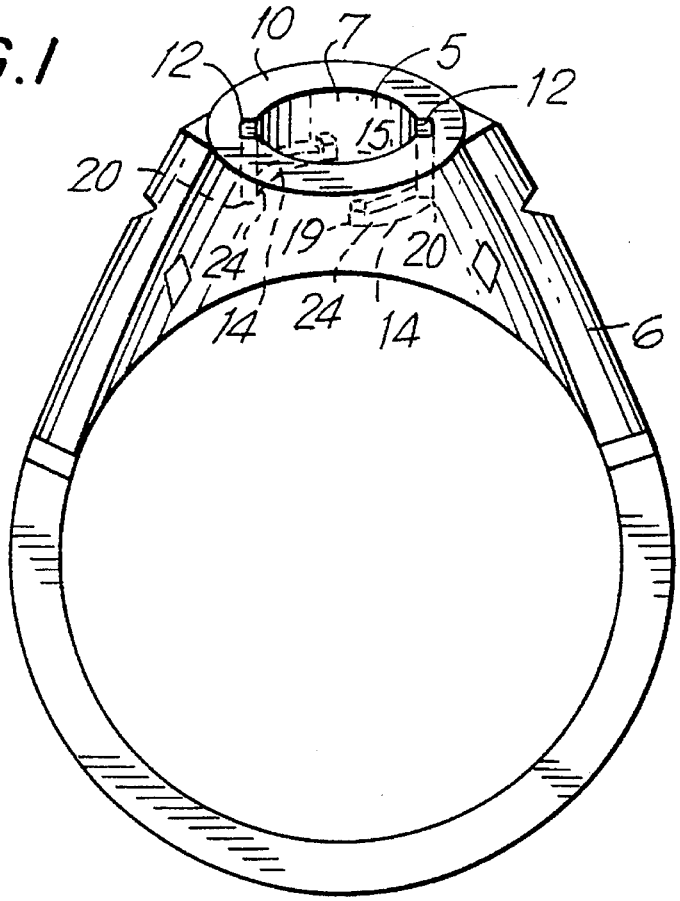
FIG. 1 is a perspective view of a ring incorporating a receiver in accordance with the present invention.
Figure 2:
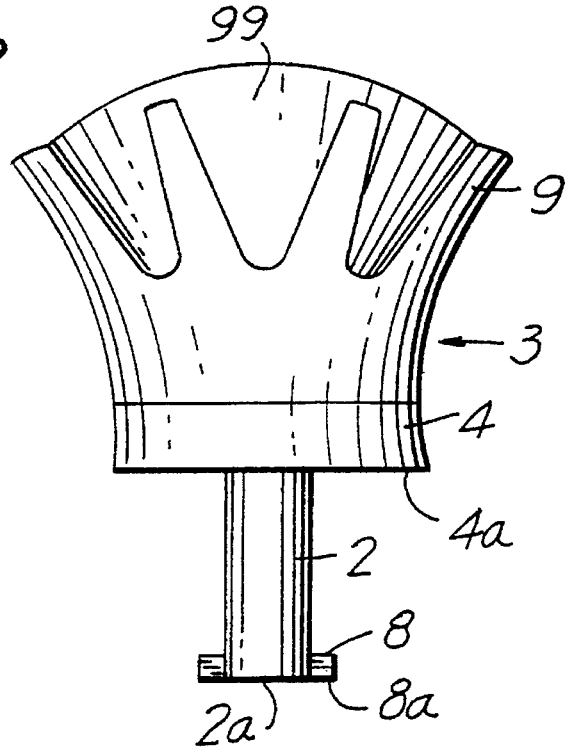
FIG. 2 is a side view of a setting incorporating a mounting means and a holding means in accordance with the present invention.

The present invention comprises interchangeable settings which are readily adaptable for use with common jewelry pieces which are found in the marketplace. As best shown in FIGS. 1 and 2, the present invention comprises an upper element 3 which is a holder for an ornament 99 such as a stone, gem stone, pearl, precious material, precious metal or the like, supported on a platform 4 which is a base area for supporting the ornament 99. Holding means 9 such as prongs are provided on the upper element 3 for securing the ornament 99. A post 2 extends from the platform 4 of the upper element 3. At the end farthest from platform 4, the post 2 has one or more projections, protrusions or keys 8. In the preferred embodiment, projections 8 are square in cross-section with the lowest surface 8*a* flush with the bottom 2*a* of post 2.

The post 2 of upper element 3 is designed to mate with a receiver 5 which can either be formed in a piece of jewelry 6 as shown in FIG. 1 or can be formed in separate adaptors such as seen in FIGS. 4 through 6. Whether as a separate adaptor or as integral with a piece of jewelry, the receiver 5 forms a housing with a central opening or cavity 7 which is circular in cross-section for receiving post 2.

Projections 8 of the post 2 interact with a corresponding groove or grooves 12 in the inner wall 15 of the cavity 7 of receiver 5. The outermost surfaces of receiver 5 is in the form of a flat lip 10 which is designed to mate with the bottom surface 4a of platform 4 of the upper element 3 assuring proper alignment of the receiver 5 and the upper element 3. Grooves 12 extend from the lip 10 parallel to the central axis of cavity 7.

Each groove 12 terminates in a groove 24. The bottom 14 of each groove 24 intersects with its corresponding groove 12 at right angles at intersection 20. Each groove 24 extends along and around the surface of cavity 7. Each groove 12 is so shaped and is of a size to allow the corresponding projections 8 of the upper element 3 to slide along its length. At intersection 20 the upper element 3 is turned such that the projections 8 slidably engages the grooves 24. The depth of grooves 12 correspond to that of post 2 so that surface 4a of platform 4 is held in contact with lip 10 when the projections 8 are in grooves 24.

Figure 9:
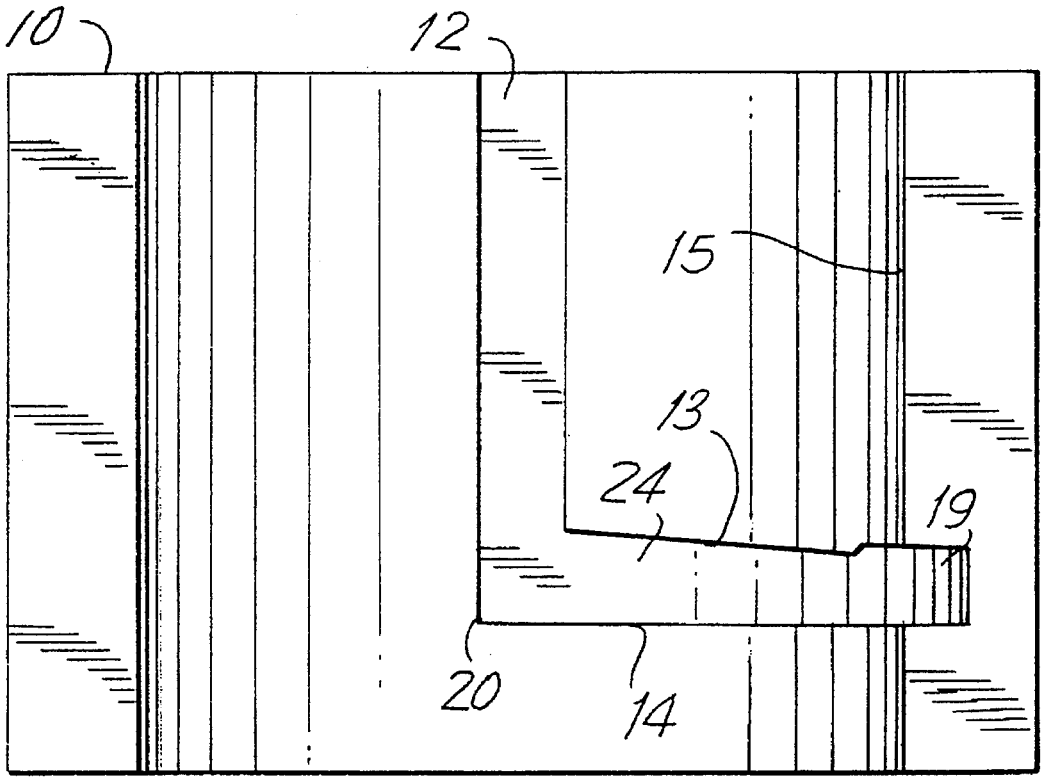
FIG. 9 is a cross-sectional view along lines 9—9 of FIG. 8.

As seen most clearly in FIGS. 5 and 9, the roof or upper surface 13 of channel 24 is at a slight angle to lip 10 and the bottom 14 of grooves 24 so as to form a downward spiral. Such angle accomplishes two purposes. First, it is of such a size and shape as to engage projections 8 in a friction fit and, secondly, when the projections are positioned in, and rotated to the far end of groove 24, bottom surface 4*a* of platform 4 is pulled into a tight engagement with lip 10 of the receiver thereby ensuring that the holding means 9 and, thus, the ornament 99 will not shake or wobble in the piece of jewelry.

The ends 19 of grooves 24 farthest from intersection 20 is slightly enlarged in comparison to the immediately prior section of grooves 24. However, this enlarged section of grooves 24 is not as large as the section of grooves 24 at intersection 20. The enlarged ends 19 of grooves 24 is so configured that there remains forced contact between lip 10 and platform bottom 4*a* when the projections 8 is in the enlarged ends 19 of grooves 24. The difference in height between the ends 19 and 20 of grooves 24 being only slight, projections 8 remains in frictional engagement with grooves 24 at ends 19. It requires additional force to move projections 8 back down the grooves 24 towards intersection 20 from ends 19. This small difference in size of grooves 24 immediately before and at ends 19 acts to hold projections 8 and to stop its movement back toward intersection 20 of grooves 24. Thus, enlarged ends 19 of grooves 24 acts as a temporary locking area for maintaining the upper element 3 in the locked position in receiver 5. The upper element 3 is removed from receiver 5 when projections 8 is in position in the enlarged ends 19 of grooves 24 by turning the upper element 3 with sufficient strength to overcome the resistance of frictional engagement such that projections 8 is moved towards intersection 20 and then through vertical grooves 12.

While, as seen in FIG. 5, the receiver 5 and its component grooves 12 and 24 may be directly formed in a piece of jewelry, such as a ring, earring, necklace, etc., a separate receiver 5 in the form of an adapter 30 may also be used. The adapter 30 can be permanently attached to a piece of jewelry by conventional means. For example, as seen in FIGS. 4 and 5, a peg 40 may extend from the bottom 36 of an adapter 30 containing receiver 5. Peg 40 is of a configuration to mate with a corresponding cavity in a piece of jewelry in a conventional manner by soldering or the like. Peg 40 can be molded in one piece with the adapter 30 or can be attached by any conventional means to the body of the adapter. Alternatively, the receiver 5 may be in the form of an insert as shown in FIG. 6 with an attaching means 41 for mounting the receiver insert into a piece of jewelry.

A washer (not shown) may be positioned on post 2 against surface 4*a* of platform 4. The washer, among other things, acts to protect the upper element 3 and particularly platform 4 against injury which may occur during temporary insertion and removal of upper element 3 in said jewelry 6. The washer may be made of any suitable material such as vinyl, rubber, plastic or metal.

Figure 7:
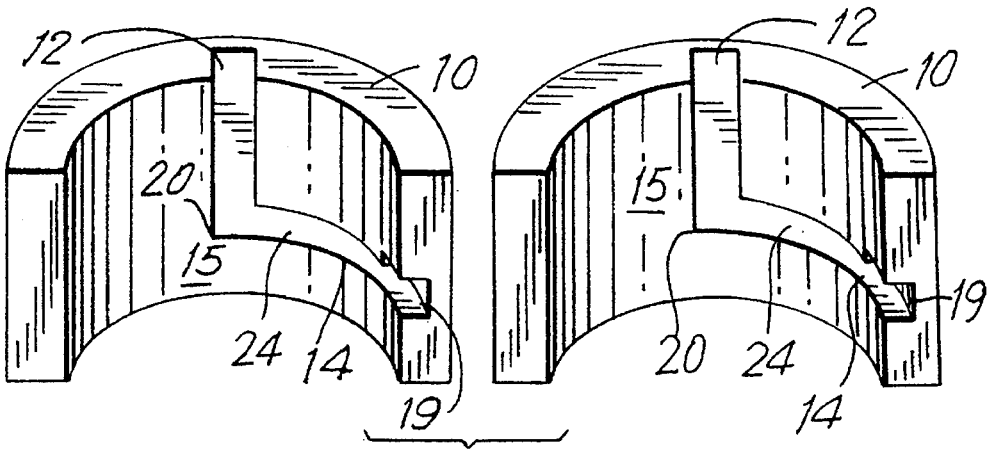
FIG. 7 is an exploded perspective view of another embodiment of the receiver made in two parts.
Figure 8:
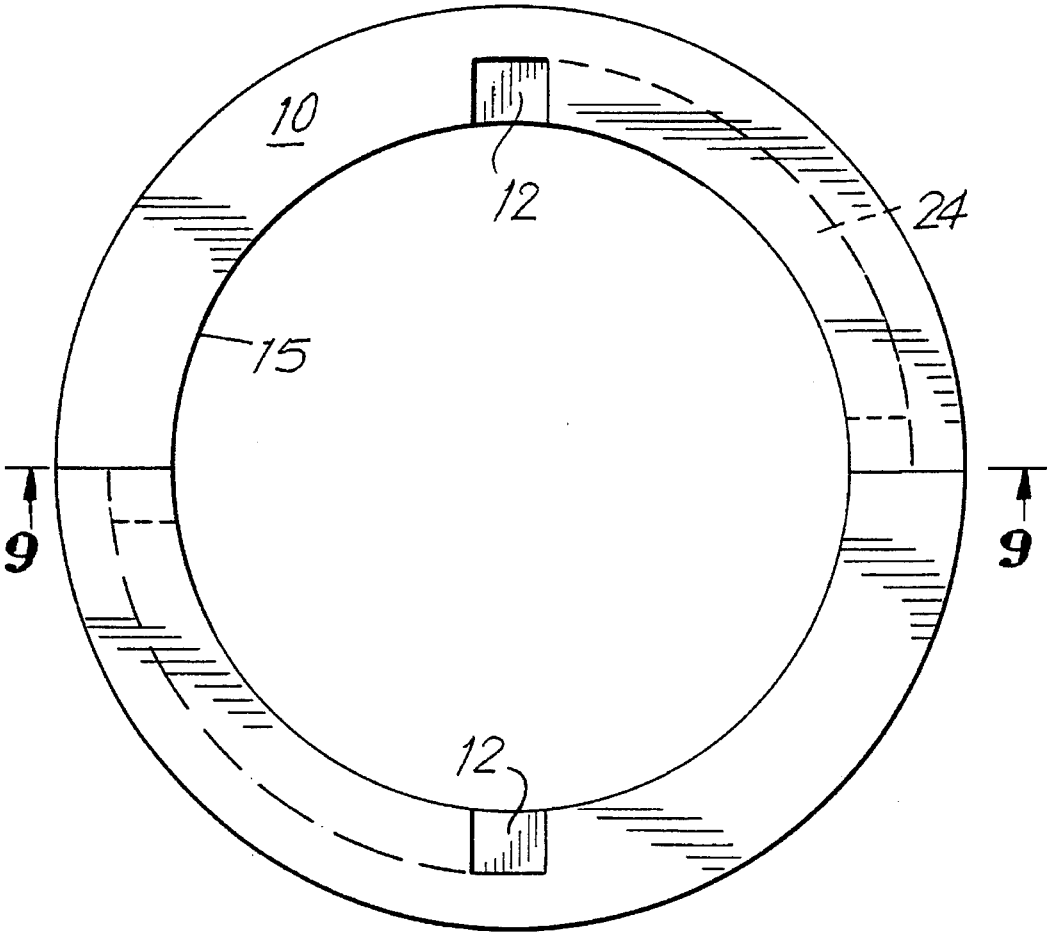
FIG. 8 is a top view of the receiver of FIG. 7 when the respective pieces are in normal operating position.

While the receiver adapter 30 may be molded in a single piece, it can be formed from two formed by combining two duplicative elements as seen in FIGS. 7 and 8.

Figure 10:
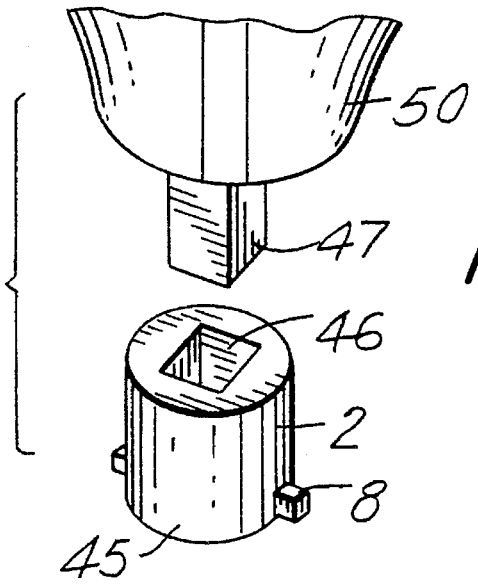
FIG. 10 is an exploded perspective view of another embodiment of the present invention wherein a conventional mounting means is used in conjunction with a male adaptor to form the mounting and holding means of the present invention.

If the ornamental element 99 is already in a conventional holding means 50, this conventional holding means 50 can be converted to that of the present invention by use of a holding means adapter 45 as seen in FIG. 10. Conventional holding means normally have a post 47 which is meant to be received in the jewelry and the piece thereafter soldered permanently in place. In accordance with the present invention, an adapter 45 may be mounted on such conventional post. The adapter 45 has a cavity 46 corresponding in shape to conventional peg 47 on holding means 50. The adapter 45 is mounted on holding means 50 by placing the peg 47 in the corresponding cavity 46 and soldering or otherwise permanently attaching the pieces together. The adapter forms a peg 2 which has projections 8 in accordance with the teachings of the present invention.

Figure 11:
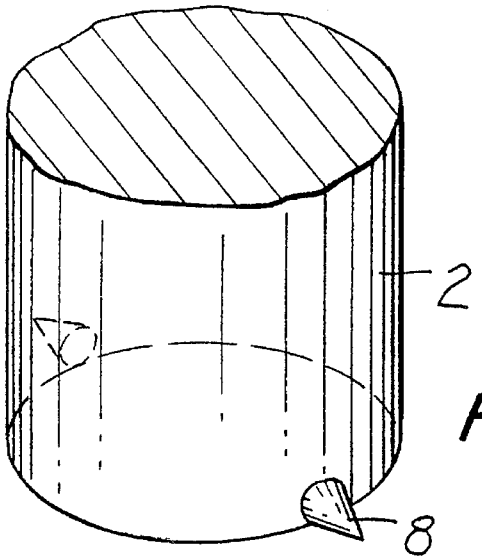
FIG. 11 is a perspective view of a holding means of the present invention in which conical shaped elements are used.
Figure 12:
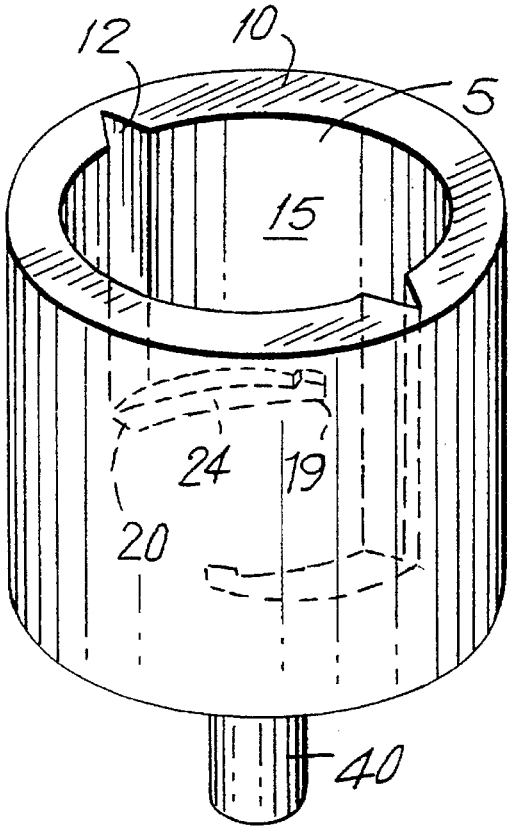
FIG. 12 is a perspective view of the receiver to receive the embodiment of the mounting means shown in FIG. 11.

While the invention has been shown in connection with projections 8 having a square crosssection, other configurations can be used. As seen in FIGS. 11 and 12, projections in the form of cones are used. The cross-section of grooves 12 and 24 are altered to correspond to the shape of the alternative conical projections, but otherwise interact as taught with regard to the embodiment of FIGS. 1–9.

After a system of the present invention has been used to allow a review of various combinations of gems and jewelry, and a selection made as to the final combination, it is desirable that there be an easy method for permanently attaching the gem to the jewelry. In the present invention, this can be done either by means of a clamping mechanism in combination with strategically located vents which will allow application of solder to permanently hold projections 8 in grooves 24. This is accomplished by having the bottom of receiver 5 have openings such that the bottom may form tabs which may be positioned against projections 8 and which would also allow the placing of solder directly within grooves 24.

This is most clearly seen in FIGS. 14–18. FIG. 16 is a bottom view of such a receiver. FIGS. 14, 15 and 16 show the peg 2 with projections 8 positioned at intersection 20 in receiver 5. The arrows show how the setting would be rotated to bring projections 8 into enlarged ends 19. FIGS. 17 and 18 show projections 8 positioned in the enlarged ends 19 of grooves 24.

The bottom surface 30 of receiver 5 has two U-shaped openings 31 and 32 forming tabs 33 and 34. The bottom 2*a* of post 2 and the bottom 8*a* of projections 8 can be seen through openings 31 and 32. If it is decided to permanently attach the gem 99, post 2 is rotated so that projections 8 are positioned in the enlarged sections 19 of grooves 24. The tabs 33 and 34 can be bent to hold projections 8 in the ends 19 of grooves 24, as seen in FIGS. 17 and 18.

At this point, solder can be added into the opening at the bottom of receiver 5 to permanently hold tabs 33 and projections 8 in position in receiver 5. While it is preferable to first move tabs 33 and 34 in position against projections 8 prior to adding solder, in certain circumstances, it may be preferable to simply position projections 8 in the enlarge ends 19 of grooves 24 and add solder directly through openings 31 and 32 without positioning the tabs 33 and 34 against projections 8.

By this method, once a decision has been reached to permanently attach the jewelry in receiver 5, it may be done expeditiously and easily.

While a specific embodiment of the invention has been shown and described in detail to illustrate the application of the principles of the invention, it will be understood that the invention may be embodied otherwise without departing from such principles.

What is claimed is:

1. An interchangeable setting for a jewelry piece for displaying an ornament, the setting comprising:

a holder for supporting the ornament;

holding means on the holder for securing the ornament;

a post attached to the holder;

a projection on the end of the post farthest from the holding means;

a receiver having a top in which is formed a cylindrical cavity for removable receiving the holder post;

a cylindrical wall forming the cavity in the receiver having a first groove parallel to a central axis of the cavity therein and a second groove therein circumferentially positioned around a portion of the cylindrical wall, said first and second grooves intersecting;

the first and second grooves having a configuration and dimensions such as to allow the projection to move therein;

said second groove starts at said intersection of the first and second grooves and terminates in an end-section consisting of a section of at least a length equal to the dimension of the projection, said end-section terminating in a wall located farthest from the intersection of the first and second grooves; and said second groove having an upper surface which spirals downwardly away from the intersection of the first and second grooves such that the distance between the top of the receiver and the upper surface of the second groove increases along the length of the second groove until the beginning of the end-section in such a manner that the further the projection is turned in the second groove away from the first groove, the farther the post is pulled into the cavity of the receiver, and the holder is pulled against the receiver.

2. The interchangeable setting of claim 1 wherein the distance between the top of the receiver and the portion of the second groove closest thereto in the end section is slightly less than the corresponding distance in the immediately preceding section of the second groove but is less than the corresponding distance at the intersection between the first and the second groove.

3. The interchangeable setting of claim 2 wherein there is frictional engagement between the projection and the upper surface the second groove.

4. The interchangeable setting of claim 2 wherein the post is integral with and forms part of the holder.

5. The interchangeable setting of claim 2 wherein the post attached to the holder having the projection is a separate detachable element which is mounted on the holder.

6. The interchangeable setting of claim 5 where the post with the projection is mounted on a second post without projections which is integral with the holder.

7. The interchangeable setting of claim 2 wherein the receiver has post means for mounting the receiver on a piece of jewelry.

8. The interchangeable setting according to claim 2 wherein the bottom of the receiver has an opening therein defining a tab so positioned that when the projection is in the end section of the second groove, such tab may be bent to hold the projection in place.

9. The interchangeable setting according to claim 2 wherein the receiver has vents of sufficient size and positioned to allow solder to be introduced into the second groove to fix the projection in the end section.

10. The interchangeable setting according to claim 2 wherein a washer is positioned on the post attached to the holder.

11. An interchangeable setting for a jewelry piece for displaying an ornament, the setting comprising:

a holder for supporting the ornament;

holding means on the holder for securing the ornament;

a post attached to the holder;

a projection on the end of the post farthest from the holding means;

a receiver having a cylindrical cavity for removable receiving the holder post;

a cylindrical wall forming the cavity in the receiver having a first groove parallel to a central axis of the cavity therein and a second groove therein circumferentially positioned around a portion of the cylindrical wall, said first and second grooves intersecting;

the first and second grooves having a configuration and dimensions such as to allow the projection to move therein;

said second groove starts at said intersection of the first and second grooves and terminates in an end-section consisting of a section of at least a length equal to the dimension of the projection, said end-section terminating in a wall located farthest from the intersection of the first and second grooves;

the dimensions of the second groove at the intersection between the first and second grooves being slightly larger that of the dimensions of the projection, the dimensions of the second decreasing along the length thereof until the beginning of the end-section in such a manner that the further the projection is turned in the second groove away from the first groove, the farther the post is pulled into the cavity of the receiver, and the holder is pulled against the receiver;

the size of the end section of the second groove is slightly enlarged in comparison to the immediately preceding section but is less than the size of the second groove at the intersection between the axial and the first and second groove; and the bottom of the receiver having an opening therein defining a tab so positioned that when the projection is in the end section of the second groove, said tab may be bent to hold the projection in place.

* * * * *